United States Patent [19]

Kwon et al.

[11] Patent Number: 4,511,399

[45] Date of Patent: Apr. 16, 1985

[54] CONTROL METHOD FOR LARGE SCALE BATCH REDUCTION OF ZIRCONIUM TETRACHLORIDE

[75] Inventors: Young J. Kwon, Fruit Heights, Utah; Harmon A. Evans, Moses Lake, Wash.

[73] Assignee: Westinghouse Electric Corp., Pittsburgh, Pa.

[21] Appl. No.: 539,026

[22] Filed: Oct. 4, 1983

[51] Int. Cl.[3] ..... C22B 25/00

[52] U.S. Cl. ..... 75/84.5; 266/195; 266/905

[58] Field of Search ..... 75/84.5; 266/195, 905

[56] References Cited

U.S. PATENT DOCUMENTS 4,105,192 8/1978 Ishimatsu et al. ..... 75/84.5 X 4,127,409 11/1978 Megy ..... 75/84.5 X 4,242,136 12/1980 Ishizuka ..... 75/84.5

*Primary Examiner*—Leland A. Sebastian

*Attorney, Agent, or Firm*—R. A. Stoltz

[57] ABSTRACT

This is a control method for large scale batch reduction of zirconium tetrachloride to zirconium metal. Solid zirconium tetrachloride is fed at least periodically into a sublimer and the sublimer heated to vaporize the zirconium tetrachloride. The vaporized zirconium tetrachloride is fed from the sublimer to a reduction vessel and a measurement is made indicative of this feed (e.g., the flow rate or the pressure in the reduction vessel). A condenser is used to conjunction with said sublimer and the temperature of the condenser is controlled to control the feed of the vaporized zirconium tetrachloride. Preferably, a flow restriction is used between the sublimer and the condenser to provide improved control.

10 Claims, 3 Drawing Figures

CONTROL METHOD FOR LARGE SCALE BATCH REDUCTION OF ZIRCONIUM TETRACHLORIDE

CROSS-REFERENCE TO RELATED APPLICATIONS

A combination reduction and distillation furnace for the production of zirconium is described in related application Ser. No. 373,588 filed Apr. 30, 1982, now abandoned, assigned to the same assignee. In addition, a filter grid arrangement for use in such a furnace is described in related application Ser. No. 528,388 filed Sept. 1, 1983 assigned to the same assignee. Although the combination of the above related applications provides for some increased production, the size of the batch is limited by the amount of zirconium tetrachloride which can be loaded into the furnace.

BACKGROUND AND SUMMARY OF THE INVENTION

This invention relates to the production of purified zirconium metal from zirconium ores and in particular to the portion of the process wherein purified zirconium tetrachloride is reacted with magnesium metal to reduce the zirconium tetrachloride to zirconium metal.

In the past, zirconium tetrachloride has been reduced in a batch process in a two-part vessel, with the zirconium tetrachloride to be reduced loaded into the top portion and the magnesium metal loaded in the bottom. An opening between the upper and lower portions of the reduction vessel is provided above the level of the solid zirconium tetrachloride such that when the zirconium tetrachloride is vaporized, the vapor can flow down into the lower portion of the vessel and react with the liquified magnesium.

It has been found that the prior art method has to major drawbacks. The amount of zirconium which can be produced in a single batch is severely limited by the amount of zirconium tetrachloride which can be loaded into practical size furnaces, and the quality of zirconium produced is substantially affected by the reaction rate, but the feed of zirconium tetrachloride into the bottom portion of the furnace can only be roughly controlled in such systems. This invention provides for controllably feeding as much zirconium tetrachloride as is required to produce the optimum amount of zirconium. In particular, the method controls the feed from a sublimer into the reduction vessel by using measurements indicative of the feed to control the temperature of a condenser located in conjunction with the sublimer. The condenser provides much more rapid control, as compared to attempts to control the rate at which the solid zirconium tetrachloride is heated and results in a higher quality product and allows a process control to be maintained even when additional zircionium tetrachloride is being fed into the subliming vessel.

BRIEF DESCRIPTION OF THE DRAWINGS

The invention can be best understood by reference to the following drawings in which.

DESCRIPTION OF THE PREFERRED EMBODIMENTS

Figure 1:
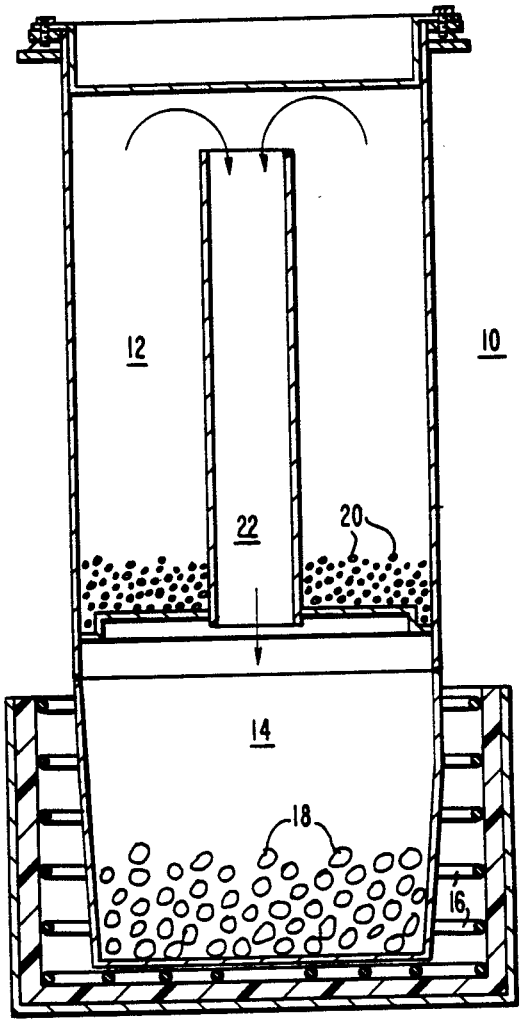
FIG. 1 PRIOR ART
FIG. 1 is a cross section of an elevation of a prior art reduction furnace.

As can be seen from FIG. 1, the prior art production technique provided only a limited amount of zirconium tetrachloride feed to the reduction furnace 10. Solid zirconium tetrachloride was loaded into the upper portion 12 and was normally vaporized by heat coming up from the lower portion 14. Normally, only a single heating means 16 was used to both melt the magnesium metal 18 and vaporize the zirconium tetrachloride 20. Even if one auxiliary heating means were used to heat the zirconium tetrachloride, the flow of zirconium tetrachloride vapor through the interconnect 22 is still basically uncontrolled as the reaction time between a change in heating rate and change of flow of zirconium tetrachloride vapor through the interconnect 22 is extremely slow (in the order of minutes).

Figure 2:
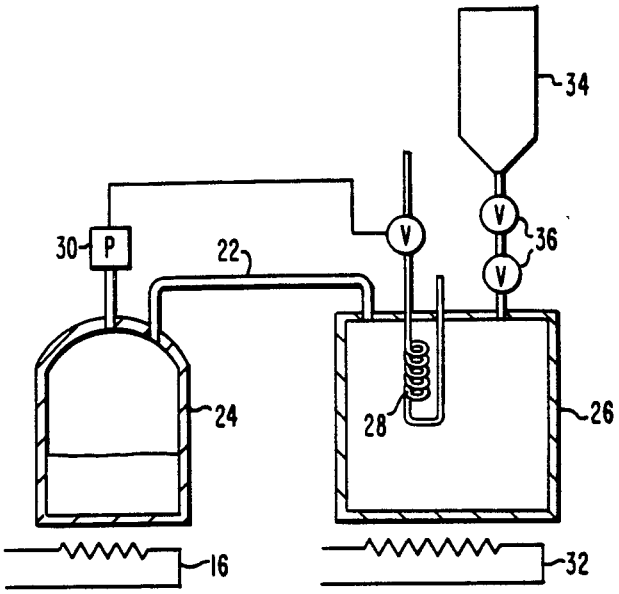
FIG. 2 shows this invention with the condenser in the sublimer having its temperature controlled by a pressure measuring device on the reduction vessel.

FIG. 2 illustrates this invention in which the reduction vessel 24 and the sublimation portion 26 are separate vessels. A condenser 28 is provided in conjunction with the sublimer 26, with the condenser coolant flow (and therefore temperature) being controlled by a pressure measuring device 30 in the reduction vessel 24. The reduction vessel 24 is heated by heating means 16 and the sublimer 26 is heated by a separate sublimer heater 32. The zirconium tetrachloride is preferably fed into the sublimer from multiple feed hoppers. FIG. 2 shows one such zirconium tetrachloride feed hopper 34 atop the sublimer 26. By closing isolation valves 36, an empty feed hopper can be removed and a full zirconium tetrachloride feed hopper can be substituted without interrupting operation of the reduction process.

Generally, this controlled method for large scale batch zirconium reduction involves feeding solid zirconium tetrachloride into a sublimer at least periodically, heating the sublimer to vaporize the zirconium tetrachloride and feeding the vaporized zirconium tetrachloride from the sublimer into a reduction vessel. Most importantly, measurements are taken indicative of the feed from the sublimer to the reduction vessel and the temperature of a condenser located in conjunction with the sublimer is controlled to regulate the feed of vaporized zirconium tetrachloride into the reduction vessel. This flow control provides for very high quality zirconium metal product and also allows feed hoppers to be changed without major changes in reduction conditions and thus allows very large batches (no longer restricted by the amount of zirconium tetrachloride which it is practical to load into a single vessel) of high quality material.

In this invention, the sublimer heating can be controlled in a number of manners and is not critical. It can be held at an essentially constant temperature, it can be allowed to vary between a maximum and minimum temperature, or it can be supplied with an essentially constant heat input. Thus, as the reaction conditions are controlled by the cooling introduced by the condenser, it can be seen that the reaction is rendered relatively insensitive to conditions in the main portion of the sublimer.

Preferably, a flow restriction is used between the sublimer and the condenser, with the interconnect being on the condenser side of the flow restriction. This provides even faster control response and renders the system more insensitive to changes in sublimer conditions which can occur, for example, during changing of feed hoppers.

Figure 3:
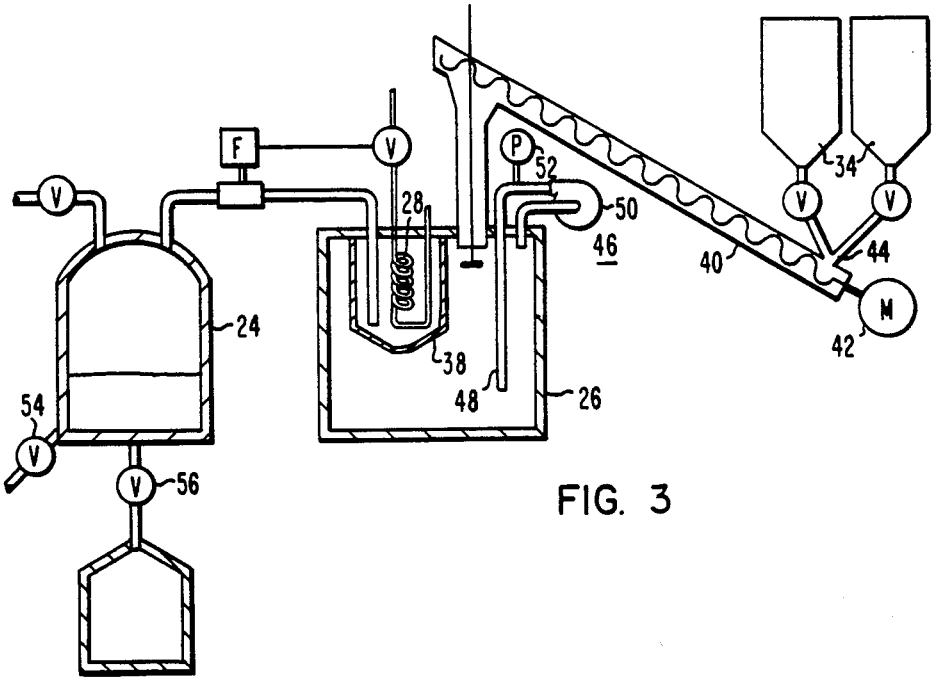
FIG. 3 shows an auger fed sublimer, with a flow restriction between the main portion of the sublimer and the condenser, and also with the condenser temperature controlled from a flow monitor.

FIG. 3 shows an alternate embodiment in which the flow restriction 38 is introduced between the main portion of the sublimer and the condenser. FIG. 3 also shows the use of a flow metering device in the interconnect as the sensor for controlling the temperature of the condenser 28. In addition, an auger type feed device 40 is used to feed solid zirconium tetrachloride from a zirconium tetrachloride feed hopper 34 into the sublimer 26. It should be noted, that the zirconium tetrachloride is (solid) is opposed to being gaseous (at the near atmospheric pressures at which these vessels are operated, the zirconium tetrachloride sublimes directly from the solid phase to the gaseous phase and no liquid is formed) and that the flake-like powder of "solid" zirconium tetrachloride can conveniently be fed by an auger. As the motor 42 rotates the auger 40, zirconium tetrachloride is fed at a relatively uniform rate, providing for a well-controlled process. The use of a "y" fitting 44 allows for two zirconium tetrachloride feed hoppers 34 to be connected at the same time or to be individually disconnected, thus providing for continuous feeding of zirconium tetrachloride. The level of solid zirconium tetrachloride in the sublimer is measured by level sensing system 46. A sensor tube 48 extends down to the level which is to be maintained. A pump 50 circulates gas and the back pressure sensor 52 senses the back pressure rise when the bottom of the sensor tube is covered with solid zirconium tetrachloride. The speed of the auger motor 42 can, for example, be controlled at below the equilibrium feed rate when the level is above the bottom of the sensor tube 48 and controlled at a speed to provide above the equilibrium feed rate when the level is below the bottom of the sensor tube 48.

The level in the reduction vessel 24 can also be monitored and magnesium chloride removes through magnesium chloride tap valve 54 to prevent the batch size from being limited by magnesium chloride by-product production.

After completion of the reduction, most of the magnesium chloride is tapped off and the magnesium tap valve 56 is opened allowing unreacted magnesium metal to flow into the magnesium recovery vessel 58. (Some magnesium chloride will also go into the recovery vessel, but this causes no problems.) The reduction vessel 24 can then be used for distillation by heating the reduction vessel 24 to a temperature which vaporizes any remaining magnesium.

The invention is not to be construed as limited to the particular forms described herein, since these are to be regarded as illustrative rather than restrictive. The invention is to cover all processes which do not depart from the spirit and scope of the invention.

We claim:

1. A control method for large scale batch zirconium reduction, said method comprising:

(a) feeding solid zirconium tetrachloride into a sublimer at least periodically;

(b) heating said sublimer to vaporize said zirconium tetrachloride;

(c) feeding said vaporized zirconium tetrachloride from said sublimer to a reduction vessel;

(d) taking measurements indicative of the feed from said sublimer to said reduction vessel; and (e) controlling the temperature of a condenser located in conjunction with said sublimer, whereby large batches of zirconium tetrachloride can be economically reduced to high quality zirconium metal.

2. The method of claim 1 wherein said sublimer is controllably heated to a substantially constant temperature.

3. The control method of claim 1, wherein vaporized zirconium tetrachloride is continuously fed from said sublimer to said reduction vessel.

4. The method of claim 3, wherein flow between said sublimer and said reduction vessel is measured and said condenser's temperature is controlled to maintain said flow substantially constant.

5. The method of claim 3, wherein reduction vessel pressure is measured and said condenser temperature is controlled to maintain the interconnecting flow between said sublimer and said reduction vessel substantially constant.

6. The method of claim 4, wherein a flow restriction is used between said sublimer and said condenser.

7. The method of claim 5, wherein a flow restriction is used between said sublimer and said condenser.

8. The method of claim 6, wherein the level of solid zirconium tetrachloride in said sublimer is measured at at least one point to maintain a minimum level of solid zirconium tetrachloride in said sublimer.

9. The method of claim 8, wherein said solid zirconium tetrachloride level is measured by measuring back pressure on a recirculation loop.

10. The method of claim 9, wherein the level in said reduction vessel is measured and magnesium chloride is at least periodically removed to maintain the magnesium chloride level in said reduction vessel in a predetermined manner.

* * * * *